US008080291B2

(12) United States Patent
Tanaka et al.

(10) Patent No.: US 8,080,291 B2
(45) Date of Patent: Dec. 20, 2011

(54) INK JET RECORDING MEDIUM AND PRODUCTION PROCESS THEREOF

(75) Inventors: Takatoshi Tanaka, Kawasaki (JP); Hiroshi Asakawa, Ebina (JP); Hitoshi Nagashima, Kawasaki (JP); Takeshi Tsurusaki, Funabashi (JP); Saki Suzuki, Urayasu (JP)

(73) Assignee: Canon Kabushiki Kaisha, Tokyo (JP)

( * ) Notice: Subject to any disclaimer, the term of this patent is extended or adjusted under 35 U.S.C. 154(b) by 106 days.

(21) Appl. No.: 12/769,061

(22) Filed: Apr. 28, 2010

(65) Prior Publication Data

US 2010/0310795 A1 Dec. 9, 2010

(30) Foreign Application Priority Data

Jun. 8, 2009 (JP) ..... 2009-137163

(51) Int. Cl.
*B41M 5/40* (2006.01)

(52) U.S. Cl. ..... 428/32.17; 428/32.21; 428/32.24; 428/32.25; 428/32.26; 428/32.34; 427/243; 427/246

(58) Field of Classification Search ..... 428/32.17, 428/32.21, 32.24, 32.25, 32.26, 32.34
See application file for complete search history.

(56) References Cited

U.S. PATENT DOCUMENTS

| | | | | |
|---|---|---|---|---|
| 5,955,185 | A | 9/1999 | Yoshino et al. | |
| 5,965,252 | A | 10/1999 | Santo et al. | |
| 6,051,106 | A | 4/2000 | Omura et al. | |
| 6,511,736 | B1 * | 1/2003 | Asano et al. | 428/195.1 |
| 6,830,790 | B1 | 12/2004 | Misuda et al. | |
| 6,848,781 | B2 | 2/2005 | Ogino et al. | |
| 7,291,361 | B2 | 11/2007 | Ogino et al. | |
| 7,662,452 | B2 | 2/2010 | Nagashima et al. | |
| 2001/0017643 | A1 * | 8/2001 | Uto et al. | 347/106 |
| 2002/0061387 | A1 * | 5/2002 | Asaoka et al. | 428/195 |
| 2005/0191441 | A1 | 9/2005 | Yamamoto et al. | |
| 2005/0237372 | A1 * | 10/2005 | Kondo et al. | 347/106 |
| 2006/0050130 | A1 | 3/2006 | Yoshida et al. | |
| 2006/0182906 | A1 | 8/2006 | Kamo et al. | |
| 2009/0011155 | A1 | 1/2009 | Kamo et al. | |
| 2010/0098866 | A1 | 4/2010 | Nagashima et al. | |

FOREIGN PATENT DOCUMENTS

| | | | |
|---|---|---|---|
| EP | 0 701 904 | A1 | 3/1996 |
| EP | 0 741 045 | A1 | 6/1996 |
| EP | 0 749 845 | A2 | 12/1996 |
| EP | 0796947 | A1 | 9/1997 |
| EP | 1 570 999 | A2 | 9/2005 |
| EP | 1 080 938 | B1 | 11/2005 |
| EP | 1609609 | A1 | 12/2005 |
| JP | 05-016015 | B2 | 3/1993 |
| JP | 07-232473 | A | 9/1995 |
| JP | 08-132731 | A | 5/1996 |
| JP | 09-059897 | A | 3/1997 |
| JP | 09-66664 | A | 3/1997 |
| JP | 09-76628 | A | 3/1997 |
| JP | 2001-138628 | A | 5/2001 |
| JP | 2002-166645 | A | 6/2002 |
| JP | 2003-048371 | A | 2/2003 |
| JP | 2003-103914 | A | 4/2003 |
| JP | 2005-246637 | A | 9/2005 |

OTHER PUBLICATIONS

Aug. 31, 2011 Chinese Official Action in Chinese Patent Appln. No. 201010197092.9.
Jun. 8, 2011 European Search Report in European Patent Application No. 10004517.8.

* cited by examiner

*Primary Examiner* — Betelhem Shewareged
(74) *Attorney, Agent, or Firm* — Fitzpatrick, Cella, Harper & Scinto

(57) ABSTRACT

An ink jet recording medium having a gas-permeable substrate, and an ink receiving layer and a surface layer provided in that order on the gas-permeable substrate, wherein the surface layer is formed through the steps of (1) applying a coating liquid comprising a first inorganic pigment and a binder onto the ink receiving layer, and (2) applying a coagulating liquid comprising a coagulant and a second inorganic pigment having a refractive index higher by 0.30 or more than that of the above first inorganic pigment and an average particle size of 100 nm or less onto the applied coating liquid to subject the coating liquid to a coagulating treatment followed by pressing a coating layer including the coating liquid and the coagulating liquid against a heated casting drum while the coating layer is in a wet condition to subject the coating layer to a cast treatment.

6 Claims, No Drawings

INK JET RECORDING MEDIUM AND PRODUCTION PROCESS THEREOF

BACKGROUND OF THE INVENTION

1. Field of the Invention

The present invention relates to an ink jet recording medium and a production process thereof.

2. Description of the Related Art

As a production process of an ink jet recording medium, it is known to form an ink receiving layer using alumina hydrate and polyvinyl alcohol as a binder and then subject the ink receiving layer to a cast treatment, thereby imparting high gloss to the ink receiving layer. Japanese Patent Application Laid-Open No. 2001-138628 discloses, as a cast treatment technique for achieving far excellent gloss, such an invention that a rewet cast treatment is conducted. As another cast treatment, a coagulating cast treatment is known, and such a method as described in Japanese Patent Application Laid-Open No. H09-059897 is disclosed.

In recent years, printing with not only a dye ink soluble in water but also a pigment ink in the form of being dispersed in water has increased. In particular, when printing is conducted with a pigment ink in which pigment is dispersed in water by a dispersant, gloss unevenness may occur between a printed area and an unprinted area in some cases, since the printed area to which the ink has been applied has a higher glossiness than the unprinted area to which no ink has been applied. In this case, a recording medium is required to have a higher glossiness to remedy the gloss unevenness, since the glossiness of the unprinted area depends on the recording medium. Thus, as a method for developing higher gloss using a casting method, Japanese Patent Application Laid-Open No. 2002-166645 discloses a method by adding fine particle colloidal silica into a coagulating liquid for coagulating cast treatment. Japanese Patent Application Laid-Open No. 2003-103914 discloses a method of improving gloss evenness by adding a cationic polyallylamine to a coagulating liquid.

On the other hand, as a method for realizing a high glossiness by another method than the cast treatment, there is known a method of developing a high glossiness by overcoating an ink receiving layer with fine particles or a resin compound. Japanese Patent Application Laid-Open No. 2005-246637 and Japanese Patent Application Laid-Open No. 2003-048371 disclose a method of enhancing glossiness by overcoating with a high-refractive index material and a method of enhancing glossiness by overcoating with a resin compound, respectively.

SUMMARY OF THE INVENTION

In the method of Japanese Patent Application Laid-Open No. 2002-166645, the glossiness is improved by adding the colloidal silica to the coagulating liquid. However, a sufficiently satisfactory glossiness cannot be achieved according to this method, and gloss unevenness may have occurred between a printed area and an unprinted area in some cases when printing has been conducted with a pigment ink. When the amount of the colloidal silica has been increased for enhancing the glossiness, the resulting recording medium has not exhibited ink absorbency sufficient to be adaptable to high-speed printing.

In an ink jet recording medium obtained by the method of Japanese Patent Application Laid-Open No. 2003-103914, the gloss evenness of the unprinted area to which no ink has been applied, i.e. of the recording medium itself, has been good. However, the invention disclosed in this prior art reference has not been such that the glossiness of the recording medium itself is greatly enhanced, and gloss unevenness may have occurred between the printed area and the unprinted area in some cases when printing has been conducted with a pigment ink.

According to the methods of Japanese Patent Application Laid-Open No. 2005-246637 and Japanese Patent Application Laid-Open No. 2003-048371, a high glossiness has been achieved. However, it has been found that the resulting recording medium does not exhibited ink absorbency sufficient to be adaptable to high-speed printing. In addition, when overcoating has been conducted on a recording medium with an ink receiving layer provided on a gas-permeable substrate, high image clarity comparable with that of a silver salt photograph has not been achieved.

The present invention has been made in view of the foregoing circumstances. In other words, the present invention has as its object the provision of an ink jet recording medium which has a high glossiness free of gloss unevenness between a printed area and an unprinted area when printing is conducted with a pigment ink and is high in image clarity and good in ink absorbency.

In an embodiment of the present invention, there is provided an ink jet recording medium comprising a gas-permeable substrate, and an ink receiving layer and a surface layer provided in that order on the gas-permeable substrate, wherein the surface layer is formed through the following steps (1) and (2); (1) a step of applying a coating liquid comprising a first inorganic pigment and a binder onto the ink receiving layer, and (2) a step of applying a coagulating liquid comprising a coagulant and a second inorganic pigment having a refractive index higher by 0.30 or more than that of the above first inorganic pigment and an average particle size of 100 nm or less onto the coating liquid applied to the ink receiving layer to subject the coating liquid onto a coagulating treatment followed by pressing a coating layer including the coating liquid and the coagulating liquid against a heated casting drum while the coating layer is in a wet condition to subject the coating layer to a cast treatment.

In another embodiment of the present invention, there is provided a process for producing an ink jet recording medium, comprising a step of applying a coating liquid comprising a first inorganic pigment and a binder onto an ink receiving layer on a gas-permeable substrate, and a step of applying a coagulating liquid comprising a coagulant and a second inorganic pigment having a refractive index higher by 0.30 or more than that of the above first inorganic pigment and an average particle size of 100 nm or less onto the coating liquid applied to the ink receiving layer to subject the coating liquid to a coagulating treatment followed by pressing a coating layer including the coating liquid and the coagulating liquid against a heated casting drum while the coating layer is in a wet condition to subject the coating layer to a cast treatment.

According to the present invention, an ink jet recording medium satisfying high glossiness and image clarity and good ink absorbency at the same time can be provided.

Further features of the present invention will become apparent from the following description of exemplary embodiments.

DESCRIPTION OF THE EMBODIMENTS

Preferred embodiments of the present invention will now be described in detail.

The ink jet recording medium according to the present invention will hereinafter be described in detail.

The ink jet recording medium is constituted by providing an ink receiving layer and a surface layer in that order on a gas-permeable substrate. The surface layer contains a first inorganic pigment, a binder, a coagulant and a second inorganic pigment and is formed through the following steps (1) and (2): (1) a step of applying a coating liquid containing the first inorganic pigment and the binder onto the ink receiving layer, and (2) a step of applying a coagulating liquid containing the coagulant and the second inorganic pigment having a refractive index higher by 0.30 or more than that of the first inorganic pigment contained in the coating liquid and an average particle size of 100 nm or less onto the coating liquid applied to the ink receiving layer to subject the coating liquid to a coagulating treatment followed by pressing a coating layer including the coating liquid and the coagulating liquid against a heated casting drum while the coating layer is in a wet condition to subject the coating layer to a cast treatment.

In other words, the surface layer is formed in the following manner. The coating liquid is first applied onto the ink receiving layer, and the coagulating liquid containing the second inorganic pigment is applied to subject the coating liquid to a coagulating treatment. The coating layer including the coating liquid and the coagulating liquid is pressed against a heated casting drum while the coating layer subjected to the coagulating treatment is in a wet condition to conduct the cast treatment, thereby forming the surface layer.

Therefore, it is inferred that in the surface layer, the first inorganic pigment is present in lower positions (side of the ink receiving layer), and the second inorganic pigment is present in upper positions (side of the surface). The second inorganic pigment has a refractive index higher by 0.30 or more than that of the first inorganic pigment. Thus, the resulting ink jet recording medium can have high glossiness and also can have high image clarity because it is subjected to the cast treatment.

The materials used in the present invention will hereinafter be described in detail.

1. Gas-Permeable Substrate

As the gas-permeable substrate, may be used an ordinary paper substrate such as wood free paper, medium grade paper or white board. A coating layer having such a thickness as completely covering the cellulose fiber or texture may be provided on the gas-permeable substrate.

2. Ink Receiving Layer

No particular limitation is imposed on materials used in the ink receiving layer. However, an inorganic pigment, a binder and a crosslinking agent are favorably used in a coating liquid for the ink receiving layer because a cast treatment is conducted upon the formation of the surface layer. The coating amount of the ink receiving layer after drying is favorably 25 $g/m^2$ or more and 45 $g/m^2$ or less from the viewpoints of volume and crack. When the coating amount is 25 $g/m^2$ or more, the whole ink receiving layer can have sufficient ink absorbency. The materials used in the ink receiving layer will hereinafter be described.

(Inorganic Pigment)

As the inorganic pigment, is favorable a white pigment such as precipitated calcium carbonate, magnesium carbonate, kaolin, barium sulfate, aluminum silicate, magnesium silicate, synthetic amorphous silica, colloidal silica, wet or dry silica sol, or alumina hydrate. Among these, silica or alumina hydrate is favorably used from the viewpoint of ink absorbency. That having a average particle size (secondary particle size) of from 100 nm to 500 nm as measured by the cumulant method is favorable.

As the alumina hydrate, may be favorably used that represented by the following general formula (X):

$$Al_2O_{3-n}(OH)_{2n}\cdot mH_2O \quad (X)$$

wherein n is any one of 1, 2 and 3, and m is a value falling within a range of from 0 to 10, favorably from 0 to 5, with the proviso that m and n are not 0 at the same time. In many cases, $mH_2O$ represents an aqueous phase, which does not participate in the formation of a crystal lattice, but is eliminable. Therefore, m may take a value of an integer or a value other than integers. When this kind of material is heated, m may reach a value of 0 in some cases.

As the crystal structure of the alumina hydrate, are known amorphous, gibbsite and boehmite type according to the temperature of a heat treatment. That having any crystal structure among these may be used. Among these, favorable alumina hydrate is alumina hydrate exhibiting a beohmite structure or amorphous structure when analyzed by the X-ray diffractometry. As specific examples thereof, may be mentioned the alumina hydrates described in Japanese Patent Application Laid-Open No. H07-232473, Japanese Patent Application Laid-Open No. H08-132731, Japanese Patent Application Laid-Open No. H09-066664 and Japanese Patent Application Laid-Open No. H09-076628.

As this alumina hydrate, is favorably used that giving a mean pore radius of 7.0 nm or more and 15.0 nm or less upon the formation of the ink receiving layer. When the mean pore radius of the ink receiving layer falls within this range, the ink receiving layer can exhibit excellent ink absorbency and color developability. If the mean pore radius of the ink receiving layer is smaller than the above range, sufficient ink absorbency may not be achieved in some cases even if the amount of the binder, such as PVA, to the alumina hydrate is controlled. If the mean pore radius of the ink receiving layer is greater than the above range, the haze of the ink receiving layer becomes great, and so good color developability may not be achieved in some cases.

In addition, pores with a pore radius of 25 nm or more are favorably substantially not present in the ink receiving layer. If pores of 25 nm or more are present, the haze of the ink receiving layer becomes great, and so good color developability may not be achieved in some cases.

Incidentally, the mean pore radius and pore radius are values determined using the BJH (Barrett-Joyner-Halenda) method from an adsorption/desorption isotherm of nitrogen gas obtained by subjecting the ink receiving layer to measurement by the nitrogen adsorption/desorption method. In particular, the mean pore radius is a value determined by calculation from the whole pore volume and specific surface area measured upon desorption of nitrogen gas.

In order to achieve a mean pore radius of alumina hydrate upon the formation of the ink receiving layer as described above, an alumina hydrate having a BET specific surface area of 100 $m^2/g$ or more and 200 $m^2/g$ or less is favorably used. The BET specific surface area is more favorably 125 $m^2/g$ or more and 175 $m^2/g$ or less. The BET method is a method for measuring the surface area of powder by a gas-phase adsorption method, and is a method for determining the total surface area that 1 g of a sample has, i.e., the specific surface area, from an adsorption isotherm. In the BET method, nitrogen gas is generally used as an adsorption gas, and a method of measuring an adsorption amount from a change in the pressure or volume of the gas to be adsorbed is oftenest used. At this time, the Brunauer-Emmett-Teller equation is most marked as that indicating the isotherm of multimolecular adsorption, called the BET equation and widely used in determination of the specific surface area. According to the BET method, the specific surface area is determined by finding an adsorption amount based on the BET equation and multiplying this value by an area occupied by a molecule adsorbed at the surface.

The favorable shape of the alumina hydrate is such a flat plate that the average aspect ratio is 3.0 or more and 10 or less, and the length-to-width ratio of the flat planar surface is 0.60 or more and 1.0 or less. Incidentally, the aspect ratio can be determined according to the method described in Japanese Patent Publication No. H05-016015. More specifically, the aspect ratio is expressed by a ratio of "diameter" to "thickness" of a particle. The term "diameter" as used herein means a diameter of a circle having an area equal to a projected area of the particle (equivalent circle diameter), which is obtained by observing the alumina hydrate through a microscope or electron microscope. The length-to-width ratio of the flat planar surface means a ratio of a minimum diameter to a maximum diameter of the flat planar surface when the particle is observed through the microscope in the same manner as in the aspect ratio.

If an alumina hydrate having an aspect ratio outside the above range is used, the pore distribution range of an ink receiving layer to be formed may become narrow in some cases. It may thus be difficult in some cases to produce alumina hydrate with its particle size controlled to be uniform. If an alumina hydrate having a length-to-width ratio outside the above range is used, the pore distribution range of an ink receiving layer to be formed also becomes narrow likewise.

Binder

Examples of a binder used include polyvinyl alcohol (PVA), oxidized starch, etherified starch, phosphoric acid-esterified starch, carboxymethyl cellulose, hydroxyethyl cellulose, casein, gelatin, soybean protein, polyvinyl pyrrolidone, maleic anhydride resins, latexes of conjugated polymers such as styrene-butadiene copolymers and methyl methacrylate-butadiene copolymers, latexes of acrylic polymers such as acrylic ester and methacrylic ester polymers, latexes of vinyl polymers such as ethylene-vinyl acetate copolymers, melamine resins, urea resins, polymer or copolymer resins of acrylic esters and methacrylic esters, such as polymethyl methacrylate, polyurethane resins, unsaturated polyester resins, vinyl chloride-vinyl acetate copolymers, polybutyl butyral, and alkyd resins.

The binders may be used either singly or in any combination thereof. Among these, PVA is most favorably used. As the PVA, may be mentioned ordinary PVA obtained by hydrolyzing polyvinyl acetate. This PVA favorably has an average polymerization degree of 1,500 or more and 5,000 or less. The saponification degree thereof is favorably 70 or more and 100 or less. The content of PVA in the ink receiving layer is favorably 5 parts by mass or more and 13 parts by mass or less per 100 parts by mass of alumina hydrate. The content is more favorably 7 parts by mass or more and 12 parts by mass or less.

Besides the above, modified PVA such as PVA cationically modified at the terminal thereof or anionically modified PVA having an anionic group may also be used.

Crosslinking Agent

No particular limitation is imposed on the crosslinking agent so far as the effect of the present invention is not impaired. However, the crosslinking agent is favorably that capable of causing a crosslinking reaction with PVA to cause curing. In particular, boric acid is favorable as the crosslinking agent. Examples of usable boric acids include metaboric acid and hypoboric acid in addition to orthoboric acid ($H_3BO_3$). However, orthoboric acid is favorably used from the viewpoints of stability with time of the resulting coating liquid and an effect of inhibiting the occurrence of cracks.

Boric acid is favorably used within a range of 5.0 parts by mass and 40 parts by mass per 100 parts by mass of PVA. If the amount used exceeds this range, the stability with time of the coating liquid may be lowered in some cases. More specifically, the coating liquid comes to be used over a long period of time upon production of the ink jet recording medium, and so viscosity increase of the coating liquid or occurrence of gelled products may occur during the production in some cases when the content of boric acid is too high. As a result, replacement of the coating liquid or cleaning of the coater head is required, so that productivity is markedly lowered. In addition, when the amount exceeds the above range, dot-like surface defects are liable to occur on the resulting ink receiving layer, and so a uniform and good glossy surface may not be obtained in some cases.

pH Adjustor

Into the coating liquid for the ink receiving layer according to the present invention, may be added, as a pH adjustor, for example, any of the following acids: formic acid, acetic acid, glycolic acid, oxalic acid, propionic acid, malonic acid, succinic acid, adipic acid, maleic acid, malic acid, tartaric acid, citric acid, benzoic acid, phthalic acid, isophthalic acid, terephthalic acid, glutaric acid, gluconic acid, lactic acid, asparagic acid, glutamic acid, pimelic acid, suberic acid, methane-sulfonic acid, and inorganic acids such as hydrochloric acid, nitric acid and phosphoric acid.

A monobasic acid is favorably used for dispersing the alumina hydrate in water. Therefore, among the above-described pH adjustors, an organic acid such as formic acid, acetic acid, glycolic acid or methane-sulfonic acid, or an inorganic acid such as hydrochloric acid or nitric acid is favorably used.

Additives

As additives for the coating liquid for the ink receiving layer, a cationic polymer, a pigment dispersant, a thickener and a fastness improver may be suitably added as needed.

3. Surface Layer

As described above, the surface layer of the present invention is formed by using a coating liquid containing the first inorganic pigment and the binder (which is hereinafter referred to also as a coating liquid for the surface layer) and a coagulating liquid for coagulating the coating liquid. The coating liquid for the surface layer and the coagulating liquid each will be described below in detail.

(Coating Liquid for Surface Layer)

The coating amount of the coating liquid for the surface layer after drying is favorably within a range of 5 $g/m^2$ or more and 40 $g/m^2$ or less, more favorably 7 $g/m^2$ or more and 30 $g/m^2$ or less. When the coating amount is 40 $g/m^2$ or less, the surface of the resulting surface layer is hard to be cracked. When the coating amount is 5 $g/m^2$ or more, a satisfactory surface layer can be formed.

First Inorganic Pigment

A first inorganic pigment in the coating liquid for the surface layer may be the same or different from the inorganic pigment used in the coating liquid for the ink receiving layer. However, the average particle size (secondary particle size) of the first inorganic pigment in the surface layer as measured by the cumulant method is favorably not smaller than the average particle size of the inorganic pigment in the ink receiving layer for more improving the ink absorbency of the resulting ink jet recording medium. The refractive index of the first inorganic pigment is favorably 1.10 or more and 2.70 or less.

Binder

No particular limitation is imposed on a binder in the coating liquid for the surface layer. However, as examples of the binder, may be mentioned starch such as oxidized starch and esterified starch, cellulose derivatives such as carboxymethyl cellulose, PVA, casein, and gelatin.

pH adjustor

The same pH adjustor as the pH adjustor for the ink receiving layer may be used in the coating liquid for the surface layer.

Additives

The additives and crosslinking agent for the ink receiving layer may be suitably used in the coating liquid for the surface layer so far as no detrimental influence is thereby imposed on the effect of the present invention though no particular limitation is imposed on the addition thereof.

(Coagulating Liquid)

Coagulant

As a coagulant for coagulating the coating liquid for the surface layer, may be used a boron compound or an ammonium salt such as ammonium formate or ammonium sulfate. When PVA is used as the binder, the boron compound is favorably used as the coagulant because it can form a crosslinked structure with PVA.

Examples of usable boron compounds include boric acid, borates (for example, orthoboric acid salts, $InBO_3$, $ScBO_3$, $YBO_3$, $LaBO_3$, $Mg_3(BO_3)_2$ and $Co_3(BO_3)_2$), diborates (for example, $Mg_2B_2O_5$ and $CO_2B_2O_5$), metaborates (for example, $LiBO_2$, $Ca(BO_2)_2$, $NaBO_2$ and $KBO_2$), tetraborates (for example, $Na_2B_4O_7.10H_2O$), and pentaborates (for example, $KB_5O_8.4H_2O$, $Ca_2B_6O_{11}.7H_2O$ and $CsB_5O_5$). Among these, sodium tetraborate (borax) is favorably used because the crosslinking reaction can be rapidly caused. The borax concentration in the coagulating liquid is favorably 1.0% by mass or more and 4% by mass or less. As the boron compound, not only borax may be used singly, but also borax and boric acid may be used in combination. In this case, the mixing ratio (by mass) of borax to boric acid is favorably within a range of from 0.3/1 to 1.5/1.

Second Inorganic Pigment

A second inorganic pigment favorably has an average particle size (secondary particle size) of 100 nm or less as measured by the cumulant method, in which the average particle size thereof is favorably smaller than the average particle size of the first inorganic pigment in the surface layer. In addition, the second inorganic pigment has such a characteristic that the refractive index thereof is higher by 0.30 or more than that of the first inorganic pigment in the surface layer. The refractive index of the second inorganic pigment is favorably 1.90 or more and 3.00 or less. Incidentally, the refractive indexes of the first inorganic pigment and the second inorganic pigment are values obtained by the Becke line method.

At least one pigment selected from the group consisting of zirconia, titanium oxide and zinc oxide is favorably used as the second inorganic pigment. The content of the second inorganic pigment is favorably 0.4 g/m$^2$ or more and 1.2 g/m$^2$ or less. The content of 0.4 g/m$^2$ or more can achieve higher glossiness, while that of 1.2 g/m$^2$ or less can achieve far excellent absorbency. The average particle size of the second inorganic pigment as measured by the cumulant method is favorably 80 nm or less for inhibiting haze to improve image quality. In the present invention, the average particle size of the second inorganic pigment is not particularly limited but favorably 1 nm or more. The content of the second inorganic pigment in the coagulating liquid is favorably 0.8% by mass or more and 1.5% by mass or less.

Release Agent

A release agent may also be added into the coagulating liquid. As the release agent, is favorable that having a melting point of from 90° C. to 120° C. When the melting point of the release agent falls within the above range, it is almost comparable to the metal surface temperature of a casting drum. Therefore, a function as the release agent can be developed to the utmost by conducting the cast treatment by the coagulation method. No particular limitation is imposed on the release agent so far as the release agent has the above-described performance.

Coating Method of Coating Liquid

The coating method of the coating liquid for the ink receiving layer and the coating liquid for the surface layer will hereinafter be described. The coating of each coating liquid is conducted by on-machine coating or off-machine coating using, for example, any of the following coating machines, so as to give a proper coating amount.

Various kinds of curtain coaters, a coater using an extrusion system, and a coater using a slide hopper system.

Upon the coating, the coating liquid may also be heated for the purpose of adjusting the viscosity of the coating liquid. The coater head may also be heated.

Upon drying of the coating liquid for the ink receiving layer, for example, a hot air dryer such as a linear tunnel dryer, arch dryer, air loop dryer or sine-curve air float dryer may be used. An infrared heating dryer or a dryer utilizing microwaves may also be suitably chosen for use.

After the coating liquid for the ink receiving layer is applied onto the gas-permeable substrate, the coating liquid is dried according to the above-described drying method to form an ink receiving layer. The coating liquid for the surface layer is then applied onto the ink receiving layer using the above-described coater. Thereafter, the coagulating liquid is applied to subject the coating surface to a coagulating treatment, and a coating layer containing the coating liquid and the coagulating liquid is pressed against a heated casting drum while the surface of the coating layer subjected to the coagulating treatment is in a wet condition, thereby drying the laminate. A glossy surface is thereby formed. The amount of the coagulating liquid applied may be suitably selected according to the desired solid weight of the second inorganic pigment and the amount sufficient to solidify the coating layer and is favorably within a range of from 40 g/m$^2$ to 80 g/m$^2$.

In the present invention, specific conditions of the cast treatment are not particularly limited but favorably as follows: the heating temperature of the cast drum is favorably 85-100° C., the pressure at the time of being pressed against the cast drum is favorably 50-100 kg/cm, and the line speed is favorably 20-50 m/min.

EXAMPLES

Example 1

Preparation of Gas-Permeable Substrate

A gas-permeable substrate was prepared in the following manner.

A paper stuff of the following composition was first prepared.

| | |
|---|---|
| Pulp slurry | 100 parts by mass |
| Laulholz bleached kraft pulp (LBKP) having a freeness of 450 ml CSF (Canadian Standard Freeness) | 80 parts by mass |
| Nadelholz bleached kraft pulp (NBKP) having a freeness of 480 ml CSF | 20 parts by mass |
| Cationized starch | 0.60 parts by mass |
| Ground calcium carbonate | 10 parts by mass |
| Precipitated calcium carbonate | 15 parts by mass |
| Alkyl ketene dimer | 0.10 parts by mass |
| Cationic polyacrylamide | 0.030 parts by mass. |

Paper was then made from this paper stuff by a Fourdrinier paper machine, subjected to 3-stage wet pressing and dried by a multi-cylinder dryer. The resultant paper was then impregnated with an aqueous solution of oxidized starch by a size pressing machine so as to give a solid content of 1.0 g/m$^2$, and dried. Thereafter, the paper was finished by a machine calender to obtain a gas-permeable substrate having a basis weight of 170 g/m$^2$, a Stöckigt sizing degree of 100 seconds, a gas permeability of 50 seconds, a Bekk smoothness of 30 seconds and a Gurley stiffness of 11.0 mN.

<Measuring Method of Average Particle Sizes of First Inorganic Pigment and Second Inorganic Pigment>

Measurement was conducted by means of ELS-Z1/Z2 (manufactured by Otsuka Electronics Co., Ltd.) in such a state that aqueous dispersions of the first inorganic pigment and second inorganic pigment had been sufficiently diluted with distilled water. The average particle size was indicated as a value calculated from analysis using the cumulant method.

<Measuring Method of Refractive Indexes of First Inorganic Pigment and Second Inorganic Pigment>

The refractive indexes of the first inorganic pigment and second inorganic pigment were measured by the Becke line method.

<Preparation of Each Liquid>

Coating Liquid for Ink Receiving Layer

Alumina hydrate Disperal HP14 (product of Sasol Co.) as inorganic alumina hydrate was first added into pure water so as to give a concentration of 30% by mass. Methanesulfonic acid was then added in a proportion of 1.5 parts by mass to 100 parts by mass of this alumina hydrate, and the resultant mixture was stirred to obtain a colloidal sol. The resultant colloidal sol was suitably diluted in such a manner that the content of the alumina hydrate is 27% by mass, thereby obtaining Colloidal Sol A.

On the other hand, polyvinyl alcohol PVA 235 (product of Kuraray Co., Ltd.; average polymerization degree: 3,500, saponification degree: 88%) was dissolved in ion-exchange water to obtain an aqueous solution of PVA having a solid content of 8.0% by mass. The PVA solution thus prepared was mixed with Colloidal Sol A prepared above in such a manner that the proportion of PVA to 100 parts by mass of the solid alumina hydrate was 9 parts by mass in terms of solid mass. A 3.0% by mass aqueous solution of boric acid was then mixed with the resultant mixture in such a manner that the proportion of boric acid to the solid alumina hydrate was 1.7% by mass in terms of solid mass, thereby obtaining Coating Liquid A for ink receiving layers. The average particle size (secondary particle size) of the alumina hydrate in Coating Liquid A was 150 nm as measured by the cumulant method.

Coating Liquid for Surface Layer

Alumina hydrate Disperal HP14 (product of Sasol Co.; refractive index: 1.65) as inorganic alumina hydrate was first added into pure water so as to give a concentration of 30% by mass. Methanesulfonic acid was then added in a proportion of 1.5 parts by mass with respect to 100 parts by mass of this alumina hydrate, and the resultant mixture was stirred to obtain a colloidal sol. The resultant colloidal sol was suitably diluted in such a manner that the content of the alumina hydrate is 27% by mass, thereby obtaining Colloidal Sol A.

On the other hand, polyvinyl alcohol PVA 235 (product of Kuraray Co., Ltd.; average polymerization degree: 3,500, saponification degree: 88%; binder) was dissolved in ion-exchange water to obtain an aqueous solution of PVA having a solid content of 8.0% by mass. The PVA solution thus prepared was mixed with Colloidal Sol A prepared above in such a manner that the proportion of PVA to 100 parts by mass of solid alumina hydrate was 9 parts by mass in terms of solid mass, thereby obtaining Coating Liquid B for surface layer. The average particle size (secondary particle size) of the first inorganic pigment (alumina hydrate) in Coating Liquid B was 150 nm as measured by the cumulant method.

Coagulating Liquid

Borax and boric acid were first added into pure water so as to give concentrations of 1.0% by mass (borax) and 2.0% by mass (boric acid), respectively. Zirconia Nanouse ZR-30BS (product of Nissan Chemical Industries, Ltd.; 30% dispersion, second inorganic pigment having a refractive index of 2.40 and an average particle size of 6 nm) was then added so as to give a concentration of 1.0% by mass. A release agent PE-262 (product of Chukyo Yushi Co., Ltd.) was further added in a proportion of 0.1 parts by mass with respect to 100 parts by mass of the above-obtained mixture to obtain a coagulating liquid.

Coating Method

Coating Liquid A was applied onto the gas-permeable substrate so as to give a dry coating amount of 30 g/m$^2$, and then dried. Coating Liquid B was then applied so as to give a dry coating amount of 10 g/m$^2$. The coagulating liquid was then applied in a wet condition so as to give an application amount of 60 g/m$^2$. After the coating surface was subjected to a coagulating treatment, the resultant coating layer was pressed against a casting drum having a surface temperature of 100° C. while the surface of the coating layer was in a wet condition, thereby producing Ink Jet Recording Medium 1.

Example 2

Ink Jet Recording Medium 2 was produced in the same manner as in Example 1 except that the zirconia in the coagulating liquid in Example 1 was changed to titanium dioxide TTO-W-5 (product of IHIHARA SANGYO KAISHA, LTD.; 30% dispersion, second inorganic pigment having a refractive index of 2.50 and an average particle size of 70 nm).

Example 3

Ink Jet Recording Medium 3 was produced in the same manner as in Example 1 except that the zirconia in the coagulating liquid in Example 1 was changed to an aqueous dispersion of zinc oxide FINEX-50 (product of SAKAI CHEMICAL INDUSTRY CO., LTD.; second inorganic pigment having a refractive index of 1.95 and an average particle size of 20 nm).

Example 4

Ink Jet Recording Medium 4 was produced in the same manner as in Example 1 except that the amount of the zirconia added into the coagulating liquid in Example 1 was changed to 0.8% by mass.

Example 5

Ink Jet Recording Medium 5 was produced in the same manner as in Example 1 except that the amount of the zirconia added into the coagulating liquid in Example 1 was changed to 1.5% by mass.

Example 6

Ink Jet Recording Medium 6 was produced in the same manner as in Example 1 except that the amount of the zirconia added into the coagulating liquid in Example 1 was changed to 0.7% by mass.

Example 7

Ink Jet Recording Medium 7 was produced in the same manner as in Example 1 except that the amount of the zirconia added into the coagulating liquid in Example 1 was changed to 1.6% by mass.

Example 8

AEROSIL 130 (product of Nippon Aerosil Co., Ltd.; refractive index: 1.45) as a gas-phase method silica was added in an amount of 25% by mass into pure water and dispersed by a high-pressure homogenizer. A cationic polymer PAS-J-81 (product of Nitto Boseki Co., Ltd.) was then added in a proportion of 7 parts by mass with respect to 100 parts by mass of the silica dispersion and dispersed by a high-pressure homogenizer. The same aqueous PVA 235 solution as that prepared in Example 1 was then mixed with the resultant dispersion in such a manner that the proportion of PVA to 100 parts by mass of solid silica was 20 parts by mass in terms of solid mass, thereby obtaining Coating Liquid C for surface layer. The average particle size (secondary particle size) of the first inorganic pigment (gas-phase method silica) in Coating Liquid C was 150 nm as measured by the cumulant method.

Ink Jet Recording Medium 8 was produced in the same manner as in Example 1 except that Coating Liquid B for surface layer in Example 1 was changed to Coating Liquid C.

Comparative Example 1

Ink Jet Recording Medium 9 was produced in the same manner as in Example 1 except that no zirconia was added into the coagulating liquid in Example 1.

Comparative Example 2

Ink Jet Recording Medium 10 was produced in the same manner as in Example 1 except that the zirconia in the coagulating liquid in Example 1 was changed to colloidal silica Snowtex-30C (product of Nissan Chemical Industries, Ltd.; 30% dispersion, refractive index: 1.45, average particle size: 10 nm).

Comparative Example 3

The same zirconia dispersion as that prepared in Example 1 was added into pure water, and a 3.0% by mass aqueous solution of boric acid was then mixed with the resultant mixture in a proportion of 3.0 parts by mass in terms of solid mass with respect to 100 parts by mass of solid zirconia. The same aqueous PVA 235 solution as that prepared in Example 1 was further mixed with the resultant mixture in such a manner that the proportion of PVA to 100 parts by mass of solid zirconia was 20 parts by mass in terms of solid mass, and the resultant mixture was diluted to prepare Coating Liquid D.

Coating Liquid D was further applied to Ink Jet Recording Medium 9 in such a manner that the coating solid weight of zirconia was 0.05 g/m$^2$, and then dried by means of a heating dryer to produce Ink Jet Recording Medium 11.

Comparative Example 4

Ink Jet Recording Medium 12 was produced in the same manner as in Example 8 except that the zirconia in the coagulating liquid in Example 8 was changed to calcium carbonate Viscoexcel-30 (product of SHIRAISHI KOGYO KAISHA, LTD.; refractive index: 1.59, average particle size: 30 nm).

Comparative Example 5

Ink Jet Recording Medium 13 was produced in the same manner as in Example 1 except that Coating Liquid A in Example 1 was not applied, and Coating Liquid B was applied so as to give a dry coating amount of 40 g/m$^2$.

<Content of Second Inorganic Pigment>

The content of the second inorganic pigment was measured by using the production process of Comparative Example 3. More specifically, Coating Liquid D of which the content of the second inorganic pigment was known was further applied onto Ink Jet Recording Medium 9 in an arbitrary coating amount. The X-ray intensity of the second inorganic pigment was then normalized by the X-ray intensity of the first inorganic pigment in the surface layer using XRF (manufactured by Rigaku Industrial Corp.; ZSXmini), thereby preparing a calibration curve. A sample prepared in each of the Examples and Comparative Examples was measured by XRF to determine the content of the second inorganic pigment using this calibration curve.

<Glossiness>

With respect to a blank portion of each of the ink jet recording media produced above, the 20° gloss was measured by means of a gloss meter (manufactured by Nippon Denshoku K.K.; VG2000) and evaluated according to the following evaluation standard.

A: the 20° gloss is 45% or more;
B: the 20° gloss is 40% or more and less than 45%;
C: the 20° gloss is 30% or more and less than 40%;
D: the 20° gloss is less than 30%.

<Image Clarity>

With respect to a blank portion of each of the ink jet recording media produced above, the C value was determined under the measuring conditions of an incident angle of 60°, an acceptance angle of 60° and an optical comb width of 2.0 mm using an image clarity meter (manufactured by Suga Test Instruments Co., Ltd.; ICM-1T) and evaluated according to the following evaluation standard.

A: the C value is 80% or more;
B: the C value is 65% or more and less than 80%;
C: the C value is less than 65%.

<Ink Absorbency>

A photo printer using an ink jet system (trade name: PIXUS iP8600, manufactured by Canon Inc.) was used, and the exclusive ink tanks for the above printer were filled with inks for pigment ink printer (trade name: PIXUS Pro 9500, manufactured by Canon Inc.). Gradation patches of from 0% to 150% duty of red, green and blue, which are secondary colors, were printed on the recording surface of each of the recording media. The printed area was visually observed to evaluate ink absorbency of each recording medium according to the following evaluation standard.

A: No beading is observed at 150% duty;
B: No beading is observed at 120% duty;
C: Beading is observed even at 120% duty.

For the ink jet recording media of Examples 1-8 and Comparative Examples 1-5, the evaluation results using the above-described evaluation methods are summarized in Table 1. In Table 1, '–' means that the difference of the refractive indices is unable to be determined because of no second pigment contained.

TABLE 1

| | Application amount of second inorganic pigment ($g/m^2$) | (Refractive index of first pigment)-(Refractive index of second pigment) | Glossiness | Image clarity | Ink absorbency |
|---|---|---|---|---|---|
| Ex. 1 | 0.5 | 0.75 | A | A | A |
| Ex. 2 | 0.5 | 0.85 | A | A | A |
| Ex. 3 | 0.5 | 0.30 | A | A | A |
| Ex. 4 | 0.4 | 0.75 | A | A | A |
| Ex. 5 | 1.2 | 0.75 | A | A | A |
| Ex. 6 | 0.3 | 0.75 | B | A | A |
| Ex. 7 | 1.3 | 0.75 | A | A | B |
| Ex. 8 | 0.5 | 0.95 | A | A | A |
| Comp. Ex. 1 | 0 | — | D | A | A |
| Comp. Ex. 2 | 0.5 | −0.20 | C | A | A |
| Comp. Ex. 3 | 0.05 | 0.75 | A | C | C |
| Comp. Ex. 4 | 0.5 | −0.06 | C | A | A |
| Comp. Ex. 5 | 0.5 | 0.75 | A | A | C |

As apparent from the results shown in Table 1, in the Examples, all of "Glossiness", "Image clarity" and "Ink absorbency" are ranked as A or B, and desired effects are developed.

On the other hand, when no second inorganic pigment was added into the coagulating liquid or the second inorganic pigment having a low refractive index was added like Comparative Examples 1, 2 and 4, a sufficient effect could not be achieved in glossiness. In addition, when the coating liquid containing the second inorganic pigment was applied to obtain an ink jet recording medium without cast treatment as in Comparative Example 3, a sufficient effect could not be achieved in image clarity and ink absorbency. Further, when no ink receiving layer was provided like Comparative Example 5, a sufficient effect could not be achieved in ink absorbency.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-137163, filed on Jun. 8, 2009, which is hereby incorporated by reference herein in its entirety.

What is claimed is:

1. An ink jet recording medium comprising a gas-permeable substrate, and an ink receiving layer and a surface layer provided in that order on the gas-permeable substrate, wherein the surface layer is formed through the following steps (1) and (2):

(1) a step of applying a coating liquid comprising a first inorganic pigment and a binder onto the ink receiving layer, and (2) a step of applying a coagulating liquid comprising a coagulant and a second inorganic pigment having a refractive index higher by 0.30 or more than that of the first inorganic pigment contained in the coating liquid and an average particle size of 100 nm or less onto the coating liquid applied to the ink receiving layer to subject the coating liquid to a coagulating treatment followed by pressing a coating layer including the coating liquid and the coagulating liquid against a heated casting drum while the coating layer is in a wet condition to subject the coating layer to a cast treatment.

2. The ink jet recording medium according to claim 1, wherein the second inorganic pigment is at least one pigment selected from the group consisting of zirconia, titanium oxide and zinc oxide.

3. The ink jet recording medium according to claim 1, wherein a content of the second inorganic pigment is 0.4 $g/m^2$ or more and 1.2 $g/m^2$ or less.

4. A process for producing an ink jet recording medium, comprising:

a step of applying a coating liquid comprising a first inorganic pigment and a binder onto an ink receiving layer on a gas-permeable substrate, and a step of applying a coagulating liquid comprising a coagulant and a second inorganic pigment having a refractive index higher by 0.30 or more than that of the first inorganic pigment contained in the coating liquid and an average particle size of 100 nm or less onto the coating liquid applied to the ink receiving layer to subject the coating liquid to a coagulating treatment followed by pressing a coating layer including the coating liquid and the coagulating liquid against a heated casting drum while the coating layer is in a wet condition to subject the coating layer to a cast treatment.

5. The production process according to claim 4, wherein the second inorganic pigment is at least one pigment selected from the group consisting of zirconia, titanium oxide and zinc oxide.

6. The production process according to claim 4, wherein a content of the second inorganic pigment is 0.4 $g/m^2$ or more and 1.2 $g/m^2$ or less.

* * * * *